US005472557A

United States Patent [19]

Storti

[11] Patent Number: 5,472,557

[45] Date of Patent: Dec. 5, 1995

[54] APPARATUS FOR FRAMING PHOTOGRAPHIC FILMS

[75] Inventor: Fabrizio Storti, Recoaro Terme, Italy

[73] Assignee: Siral s.r.l., Valdagno, Italy

[21] Appl. No.: 334,581

[22] Filed: Nov. 4, 1994

[30] Foreign Application Priority Data

Nov. 10, 1993 [IT] Italy ..... VI93A0180

[51] Int. Cl.[6] ..... B65B 63/00

[52] U.S. Cl. ..... 156/514; 53/520; 53/284.2

[58] Field of Search ..... 156/269, 522, 156/270, 552, 514; 53/520, 284.2; 83/614

[56] References Cited

U.S. PATENT DOCUMENTS

| | | | |
|---|---|---|---|
| 3,807,121 | 4/1974 | Mundt et al. | 53/520 X |
| 3,992,243 | 11/1976 | Berggren et al. . | |
| 4,004,340 | 1/1977 | Urban | 53/520 |
| 4,135,343 | 1/1979 | Urban et al. . | |
| 4,237,678 | 12/1980 | Thompson | 53/520 |
| 4,528,795 | 7/1985 | Stemmer et al. | 53/520 X |
| 4,543,771 | 10/1985 | Jensen et al. | 53/520 |
| 4,665,681 | 5/1987 | Facchini et al. | 53/520 |
| 4,934,128 | 6/1990 | Savio et al. | 53/520 |
| 5,168,688 | 12/1992 | Nevhold | 53/520 |
| 5,222,347 | 6/1993 | Gerrans | 53/520 |

FOREIGN PATENT DOCUMENTS

| | | | |
|---|---|---|---|
| 59665 | 11/1993 | European Pat. Off. | 53/520 |

*Primary Examiner*—James Engel
*Assistant Examiner*—Steven J. Helmer
*Attorney, Agent, or Firm*—Bucknam and Archer

[57] ABSTRACT

The apparatus is capable of framing automatically photographic films by means of a first operation according to which the film is divided into several photograms and a second operation according to which the photograms are introduced into the interior of frames which are mechanically opened on one side, thus obtaining as the final product the "diapositiva", that is slide or filmslide (12).

3 Claims, 6 Drawing Sheets

APPARATUS FOR FRAMING PHOTOGRAPHIC FILMS

FIELD OF INVENTION

The object of the present invention is to provide an apparatus to frame automatically photographic films by means of a first cutting operation of the same film in individual photograms and a second operation which involves the introduction of the same photograms in the interior of small frames which are mechanically opened on one side thus obtaining as the final article the so called "diapositiva" that is slide or filmslide.

This diapositiva, slide or filmslide, presents itself as a small frame of substantially quadrilateral shape and with standardized dimensions, the small frame being made of a plastic material and being constituted by two half-frames or valves which being reciprocally bonded one to the other hold the photograms between them.

BACKGROUND OF THE INVENTION

A very well known type of a small frame provides the two half-frames or valves being bonded between themselves along three sides while the fourth side remains free in order to allow the introduction of the photogram according to the framing operation.

According to the present state of the art, several methods and apparatuses are known for the sub-division of the photographic film in individual photograms and for the subsequent operation of framing the same. The main drawback of the methods used up to the present in the framing operation consists of the possibility of damaging the photogram during the insertion of the same in the small frame. This is due to the fact that the introduction of the photogram through the opening formed by the two free sides of the two valves facing each other and the centering of the same with respect to the two valves is made through entrainment means such as pincers or sucking means which, acting on the surfaces of the same photogram cause in general scratching and damages and in addition limit the speed of operation and production capacity of the apparatus.

A partial solution of the problems discussed hereinabove is obtained by means of framing apparatuses in which the photographic film moves in the orthogonal direction towards the open side of the two valves which are reciprocally bonded. Therefore, after the initial part of the film is inserted in the interior of the small frame, one proceeds with cutting of one piece or the photogram by means of a cutting blade which acts in the interior of the profile of the same small frame.

Thus the apparatus on one hand eliminates the means for the manipulation of the film because the film positions itself automatically in the interior of the frame due to its advance motion but it also has the drawback that the two sides of the two half frames which are facing one to the other and which are free, must be substantially diverging one from the other in order to permit the introduction of the cutting member of the film with the result that there is the possibility of a permanent inflection of the half-frames or breakage of the soldering points so that a perfect closing of the frame at the end of the operation is not obtained.

SUMMARY OF THE INVENTION

One object of the present invention is to eliminate all the drawbacks mentioned hereinabove with an apparatus in which on one hand the orthogonal disposition between the direction along which the film is fed and the direction along which the same frames are fed is kept but the cutting of the film is carried out when the film is only partially inserted between the two valves outside of the profile of the same frame.

The novel features of the present invention are:

1. The cutting means which are positioned outside of the frame consist of a cutting blade which moves in the interior of the upper part of the member which causes the opening of the two sides and a counterblade positioned in the lower part which is integral with the same member and which serves for resting the film;
2. The operation of centering of the photogram where the photogram remains still while the frame is caused to advance from the exterior and therefore without requiring a manipulation of the same photogram.

The very simple construction of the frame permits to achieve a high speed of operation ensuring at the same time the perfect positioning of the photogram in the interior of the frame.

The invention will now be described according to a preferred embodiment of the invention which is described hereinbelow by way of a non-limiting example because certain changes in the technical details and in the details of operation may be made without departing from the scope of protection, by reference to the drawings attached hereto of which:

FIG. 3 is a view of the detail of FIG. 2 of the area along which the free sides of the small frame diverge;

Figure 1:
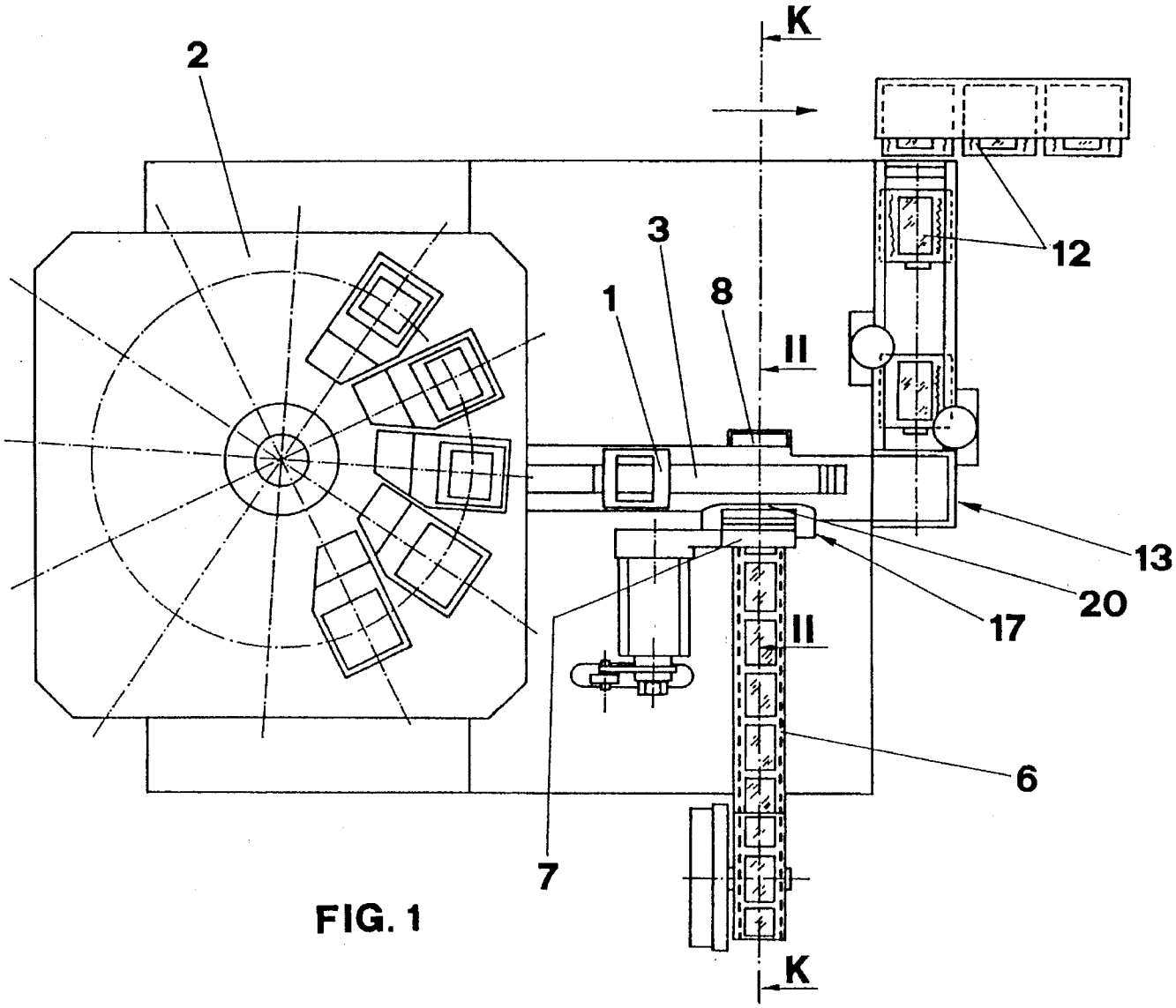
FIG. 1 is a plan overall view of the apparatus in the rest phase.
Figures 5, 6:
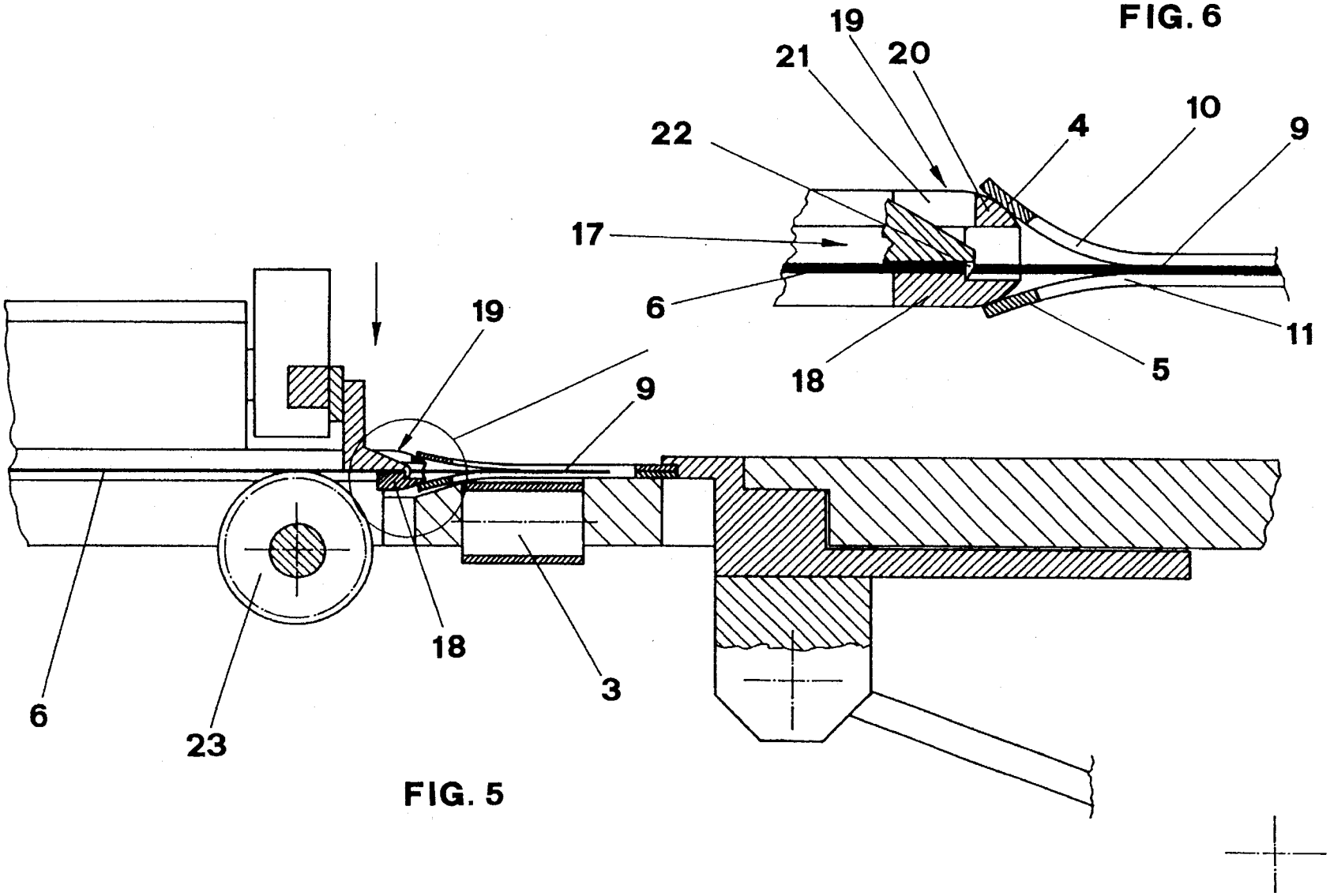
FIG. 5 is a vertical view in cross section along the lines of II—II FIG. 1 of the working area in the cutting phase of the film.
FIG. 6 is a view of the detail of FIG. 5 of the cutting area of the film.
Figure 8:
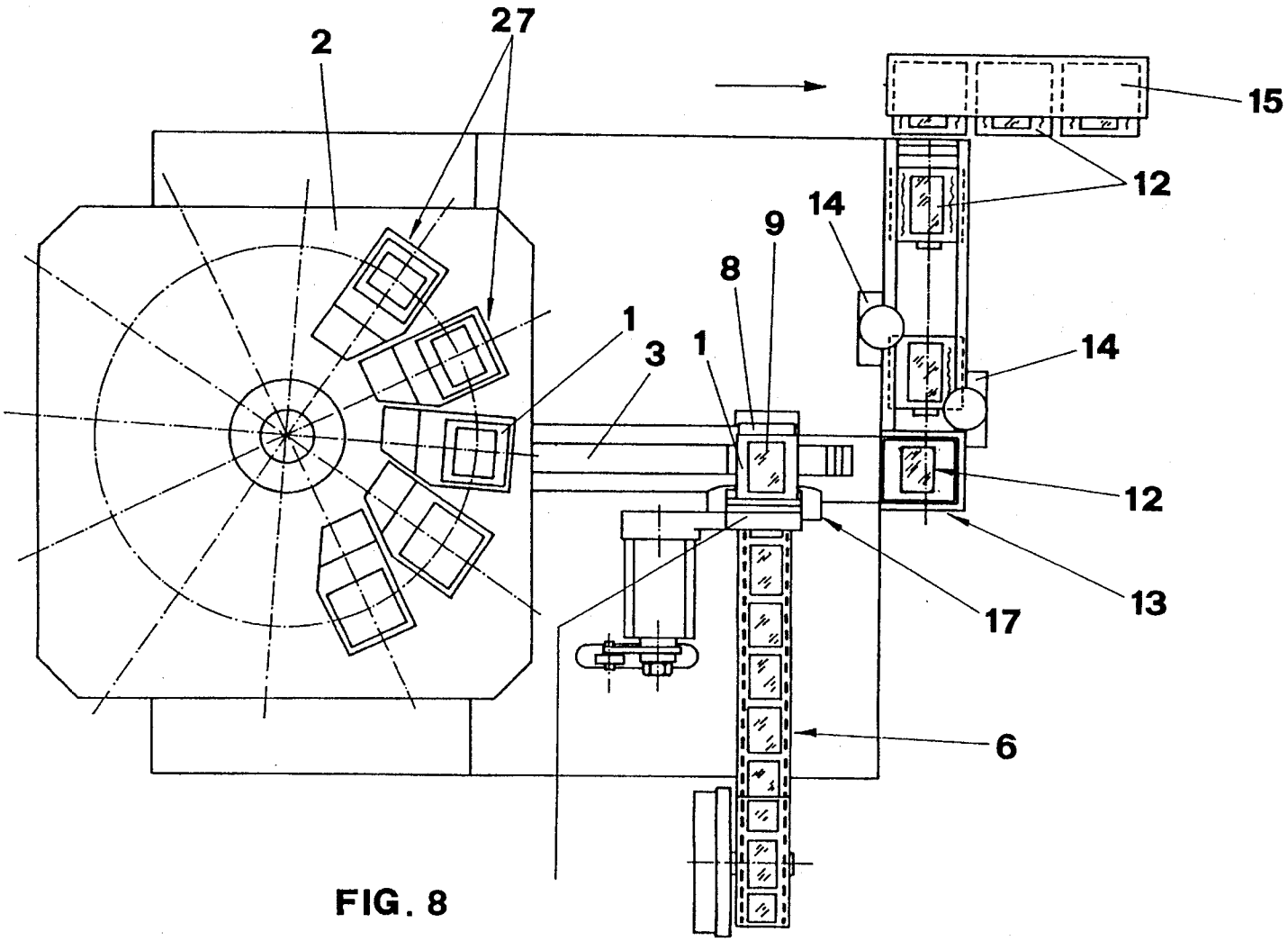
FIG. 8 is the overall plan view of the apparatus in the working phase.

As shown in FIGS. 1 and 8, the small frames (1) which come from the rotating storehouse (2) are pushed and are positioned in the working zone represented by the line K—K by means of the transport belt (3). Along the line K—K and orthogonally with respect to the border of the frame (1) which has its limbs (4) and (5) free, takes place the feeding of the photographic film (6) as shown in FIGS. 3 and 6.

By means in succession of the action of the cutting member (7) and the advancing group (8) of the frame which will be described better hereinbelow, there is accomplished the framing of a piece of the film designated as photogram (9) in the interior of the two valves which constitute the same frame so that in this manner the final article of the operation is obtained which results in the diapositiva, that is slide or filmslide, (12).

By means of the same belt (3) the diapositiva, that is slide or filmslide (12) are deposited in the collection pocket (13) where they remain until they are picked up for the subsequent operations such as stamping, by stamping device (14), as shown in FIG. 8 and positioning by means (15).

Figure 2:
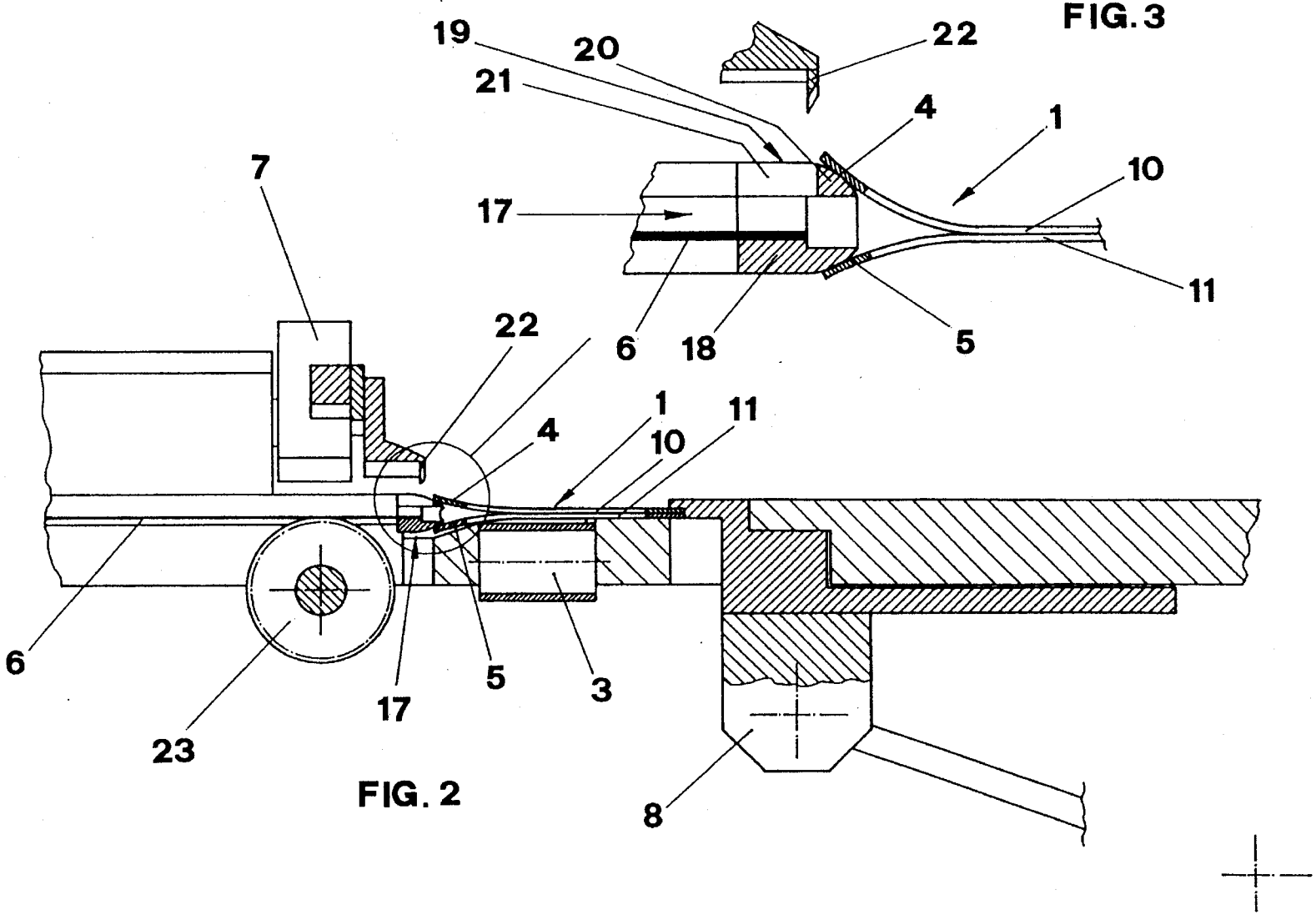
FIG. 2 is a vertical view in cross section along the lines II—II of FIG. 1 of the working zone in the phase of opening the free side of the frame.

The details of the entire operation of framing is visible in FIGS. 2–7. FIGS. 2 and 3 show the initial phase of the operation which consists of opening the frame (1) by the inflection of the limbs (4 and 5) of the respective valves (10 and 11) and in the positioning of the same frame for the reception of the film (6).

The reciprocal diverging of the limbs (4 and 5) occurs during the phase when the frame (1) advances when the limbs meet the fixed profile (17) which has a width slightly greater than the width of the photographic film (6), this profile (17) being placed in transversal position with respect to the film and in a direction parallel to the direction of advance of the same frame. The profile (17) is shaped as two half-shells which are integral between themselves, the lower one (18) on which the film (6) rests, which film advances and the upper one (19) which is shaped so as to present a bridge (20) and a rear opening (21) which permits the lowering of the cutting blade (22).

Figure 4:
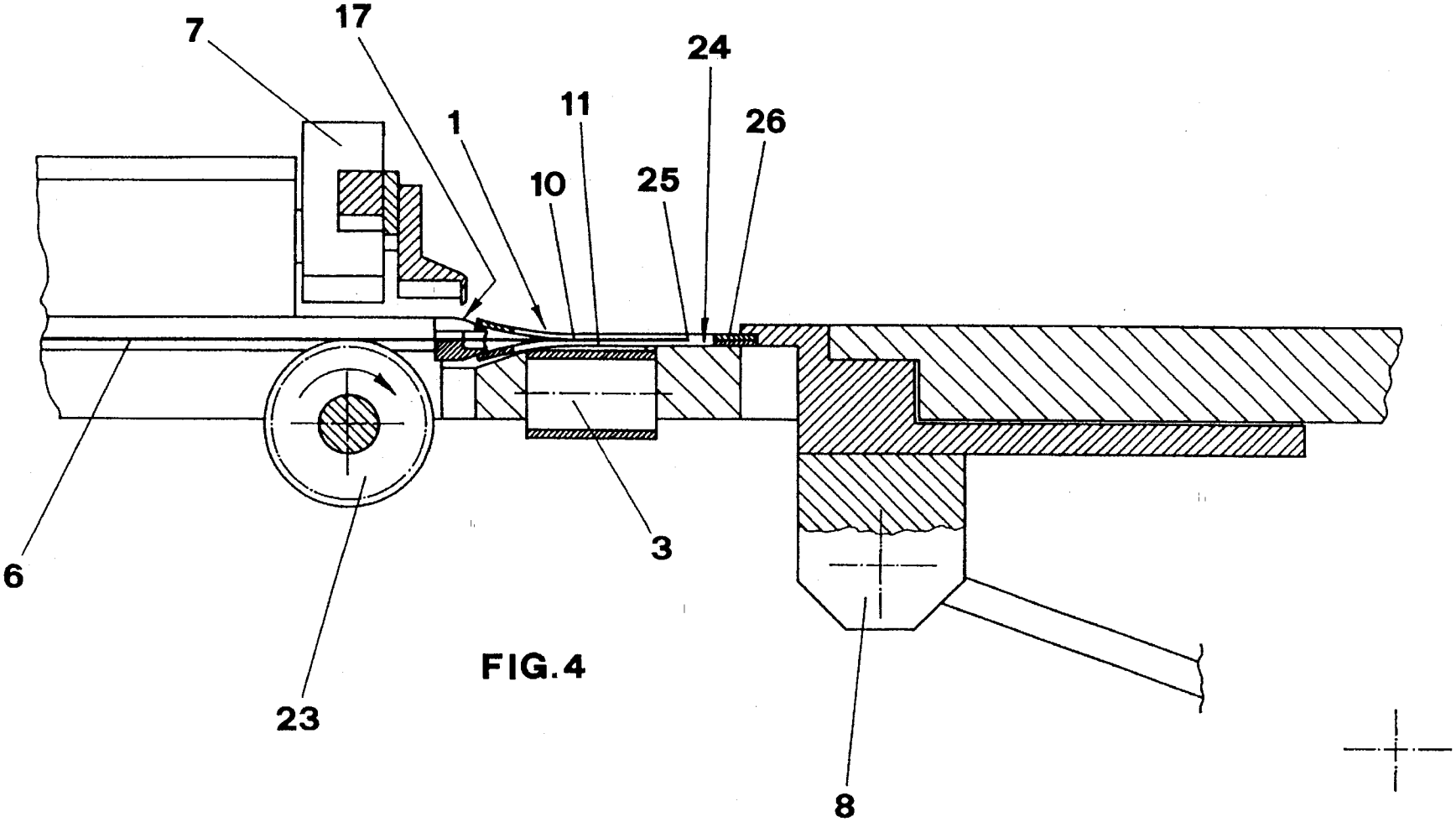
FIG. 4 is a vertical view in cross section along lines II—II of FIG. 1 of the working area in the phase in which the film is partially introduced into the interior of the frame.

When the frame (1) stops in a frontal position with respect to the film (6), the film being carried by mechanical means (23) which is introduced between the valves (10 and 11) of the same frame. The mechanical means (23) are known. As shown in FIG. 4, the film (6) is introduced only partially between the valves (10 and 11), about ¾ of the frame so as to leave a free space (24) between the extremity (25) of the film and side (26) of the frame (1).

The subsequent operation which is illustrated in FIGS. 5 and 6 and which is intended to obtain the photogram (9), is carried out by lowering of the cutting blade (22), followed by the successive raising of the same cutting blade 22, through the opening (21) formed on the half-shell (19). The blade proceeds to cut the film (6). Also the lower half-shell (18) where the counterblade is located cooperates in this operation.

Figure 7:
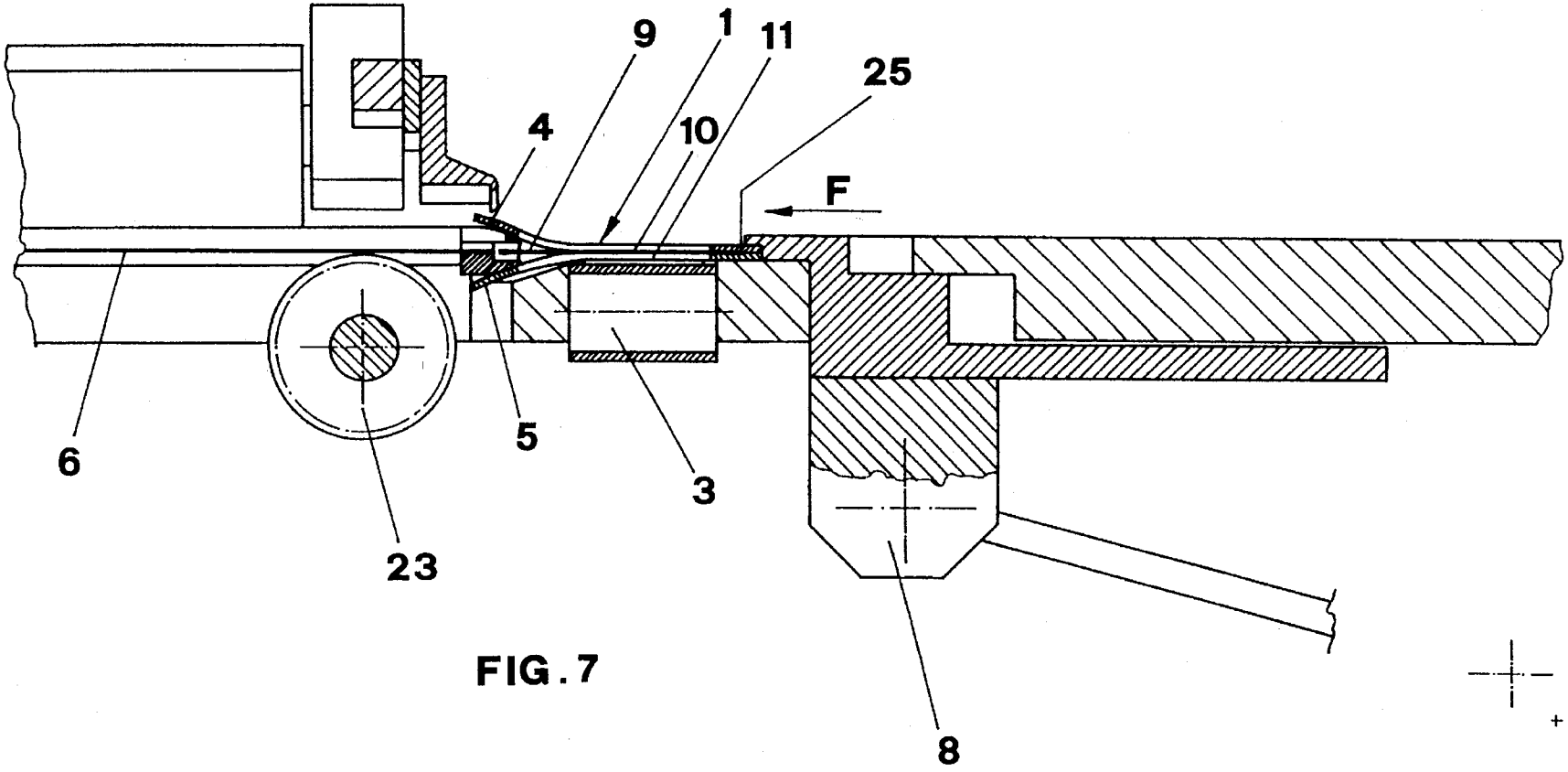
FIG. 7 is a vertical view in cross section along lines II—II of FIG. 1 of the working zone in the phase of positioning the frame on the internal photogram.

After the photogram (9) is obtained, the centering operation of the same photogram in the interior of the frame (1) is carried out through the action of the pushing group (8) as shown in FIG. 7.

The advance according to the direction of the arrow F of the pushing means (8) occurs in such a manner that the entire frame (1) slides in the same direction while the photogram (9) remains blocked against the counter-blade which is integral with the half shell (18).

The action of advancing of the frame eliminates the hollow space (24) and the image of the photogram (9) positions itself exactly centrally in the opening of the two valves (10 and 11). After the centering of the photogram (9), the same belt (3) moves again to position the frame (1) away from the profile (17) so that the two limbs (5 and 6) return to mate one with the other, thus closing the opening of introduction of the film and forming the diapositiva, that is slide or filmslide (12) which deposits itself in the receipt pocket (13).

Advantageously, the small pockets (27) of the rotating storehouse (2) in which are deposited the small frames (1) have sides which are not parallel with respect to the axis of the belt (3), also when they are in a position corresponding to the feeding direction of the same belt. This permits to avoid the drawback which would occur in the case in which these pockets were parallel with respect to the axis of the belt (3) because the small frame removed from the belt (3) would have a tendency to hook itself to the small frame which is placed in position immediately above on the pile contained in one of the pockets (27).

What is claimed is:

1. Apparatus for framing a photographic film which comprises:

a) a storehouse for hollow frames (1), b) means (3) for advancing said hollow frames (1) from said storehouse (2) towards a working zone (K—K), each of said frames (1) being composed of two valves (10 and 11), said valves having four sides and being bonded to each other along three sides thereof, said valves having limbs (4 and 5), c) means (23) for advancing a film (6) to said working zone, d) a profile (17) located transversely with respect to said film (6); said limbs (4 and 5) being adapted to diverge when they meet said profile (17), said profile (17) being constituted by two semi-shells (18 and 19) one of which (19) is superimposed over the other (18) and being integral between themselves, said two half-shells being capable of diverging said limbs (4 and 5) of one of said frames (1) whereby a portion of said film (6) is inserted in the interior between said valves (10 and 11) of said frame (1), said film having an extremity (25), said frame (1) having a side (26), whereby a free space is left between said extremity of said film (25) and said side (26), e) a cutting blade (22), said half-shell (19) which is superimposed on said half-shell (18) having an opening (21) on the shoulder of a bridge (20), said blade (22) going through said opening (21) whereby said film (6) is cut externally with respect to said frame (1), whereby a plurality of photograms is obtained;

f) a counterblade which is integral with said lower-half shell (18), said counterblade being adapted to stop said photogram downstream of said cutting blade, means (8) for advancing said frame (1) towards said counterblade whereby the total insertion of said photogram (9) within said frame (1) is achieved.

2. The apparatus according to claim 1 wherein said film (6) is inserted in said frame (1) to an extent of about ¾ of the dimension of said frame which is parallel to said film.

3. The apparatus according to claim 1 wherein said advancing means (3) is a belt, said storehouse (2) rotates and has a plurality of receptacles (27) and said frames (1) are placed as a pile within said receptacles (27).

* * * * *